US008596912B2

(12) United States Patent
Routeau et al.

(10) Patent No.: US 8,596,912 B2
(45) Date of Patent: Dec. 3, 2013

(54) DEVICE FOR MOUNTING A FLEXIBLE LINE ON A STRUCTURE, AND RELATED INSTALLATION AND METHOD

(75) Inventors: Sylvain Routeau, Saint Cloud (FR); Tegwen De Kerdanet, Paris (FR)

(73) Assignee: Technip France (FR)

( * ) Notice: Subject to any disclaimer, the term of this patent is extended or adjusted under 35 U.S.C. 154(b) by 255 days.

(21) Appl. No.: 12/995,213

(22) PCT Filed: May 27, 2009

(86) PCT No.: PCT/FR2009/050983

§ 371 (c)(1), (2), (4) Date: Mar. 22, 2011

(87) PCT Pub. No.: WO2009/156639

PCT Pub. Date: Dec. 30, 2009

(65) Prior Publication Data

US 2011/0162747 A1 Jul. 7, 2011

(30) Foreign Application Priority Data

May 30, 2008 (FR) ..... 08 53587

(51) Int. Cl.
*F16L 1/12* (2006.01)

(52) U.S. Cl.
USPC ..... 405/168.1; 405/158; 166/359

(58) Field of Classification Search
USPC ..... 405/158, 166, 168.1, 168.3, 168.4, 405/224.2; 166/359
See application file for complete search history.

(56) References Cited

U.S. PATENT DOCUMENTS

| | | | | |
|---|---|---|---|---|
| 2,799,344 | A | 7/1957 | Muse | |
| 4,808,034 | A * | 2/1989 | Birch | 405/195.1 |
| 4,943,188 | A * | 7/1990 | Peppel | 405/223.1 |
| 5,437,518 | A * | 8/1995 | Maloberti et al. | 405/169 |
| 5,947,642 | A * | 9/1999 | Teixeira et al. | 405/195.1 |
| 6,386,798 | B2 * | 5/2002 | Finn | 405/224.2 |
| 6,527,053 | B2 * | 3/2003 | Friisk | 166/346 |
| 6,558,084 | B2 * | 5/2003 | Moog et al. | 405/224 |
| 7,293,940 | B1 * | 11/2007 | Perreau-Saussine et al. | 405/224.2 |

FOREIGN PATENT DOCUMENTS

| | | | |
|---|---|---|---|
| EP | 0565445 | A | 10/1993 |
| GB | 1478214 | A | 6/1977 |
| WO | WO 98/23845 | A | 6/1998 |
| WO | WO 2005095198 | A1 * | 10/2005 |
| WO | WO 2006/041904 | A | 4/2006 |

OTHER PUBLICATIONS

International Search Report dated Dec. 1, 2009, issued in corresponding international application No. PCT/FR2009/050983.

* cited by examiner

*Primary Examiner* — Benjamin Fiorello
(74) *Attorney, Agent, or Firm* — Ostrolenk Faber LLP

(57) ABSTRACT

A device includes a hollow rigid member (40) and a curvature limiter (42) movable relative to the hollow rigid member (40). A releasable device (46) for axial immobilization of the curvature limiter (42) on the flexible line (18) in at least one first direction along a travel axis (X-X'). The axial immobilization device (46) includes a locking member (90) axially secured to the flexible line (18), and a member (92) for fitting the locking member (90), axially secured to the curvature limiter (42). Those members (90, 92) are movable relative to each other around the travel axis (X-X') between a configuration for axial immobilization of the flexible line (18) on the curvature limiter (42), and a configuration for axial travel of the flexible line (18) across the curvature limiter (42).

15 Claims, 6 Drawing Sheets

92
96
108
110
112
120
122
124
126A
126B
128
130
132
134A
134B
136
138
102
104
105
(a)
(b)
(c)
(d)
(e)
(f)
(g)
(h)
(i)
46

DEVICE FOR MOUNTING A FLEXIBLE LINE ON A STRUCTURE, AND RELATED INSTALLATION AND METHOD

CROSS REFERENCE TO RELATED APPLICATIONS

The present application is a 35 U.S.C. §371 National Phase conversion of PCT/FR2009/050983, filed May 27, 2009, which claims benefit of French Application No. 08 53587, filed May 30, 2008, the disclosure of which is incorporated herein by reference. The PCT International Application was published in the French language.

BACKGROUND OF THE INVENTION

This invention relates to a device for mounting a flexible line on a structure, of the kind comprising:

- a hollow rigid member, intended to be integral with the structure, the hollow rigid member defining a traveling way of the flexible line;
- a curvature limiter defining an insertion lumen of the flexible line, with the insertion lumen having a travel axis of the flexible line, the curvature limiter being movable relative to the hollow rigid member between a position away from the hollow rigid member and a position mounted on the hollow rigid member;
- releasable means for axial immobilization of the curvature limiter on the flexible line in at least one first direction along a travel axis, for moving the flexible line together with the curvature limiter relative to the hollow rigid member between the position away from the hollow rigid member and the mounted position.

Such mounting devices are used in hydrocarbon exploitation installation on a body of water, including for instance a fixed rigid structure on the seabed, an oscillating structure secured to the seabed, or a floating structure, such as a surface naval base, a semisubmersible platform, a floating vertical column, or a vessel.

The flexible line to be mounted on the structure is for instance a flexible rising fluid carrying pipe, a so-called riser. Herein "flexible pipes" are understood to mean those described in the standards published by the American Petroleum Institute (API), API 17J and API RP 17 B, and well known to the person skilled in the art. More generally, the flexible line can be a bundle-like composite harness, a set of umbilicals or electrical cables.

A mounting device of the aforementioned type is used when installing and connecting the flexible line to the surface structure.

For this purpose, in order to reduce the risks of damaging the structure and the flexible line, it is known to immerse the flexible line into the body of water below the surface structure and to lift it up to the connecting area located on the surface structure by means of a hoist. Such a connection is referred to by the term pull-in.

The flexible line is guided over the structure by introducing the same through a hollow rigid tube integral with the structure and oriented vertically, which is a protective sleeve. The hollow tube is for instance of the "I tube" or "J tube" type.

At the upper outlet of the tube, the flexible line is connected to the surface installation.

In order to avoid any deterioration of the flexible line, namely under the effect of water agitation likely to bring it into contact with the structure, it is known to engagedly mount around the flexible line a curvature limiter adapted to locally impose a radius of curvature greater than the minimum radius of curvature which may be adopted by the flexible line.

Hereafter, curvature limiters are understood to both curvature limiters, composed e.g. of articulated rigid elements called "vertebrae", and stiffeners, composed e.g. of plastic molded blocks, as well as combinations thereof.

A stiffener is for instance arranged around the flexible line close to the upper end thereof, so as to cooperate with the hollow tube when the flexible line is inserted into the tube.

For this purpose, first of all, the stiffener and the flexible line are moved together to the lower end of the hollow tube until the stiffener has been partially inserted into the hollow tube. Next, in a second stage, the flexible line is moved upward in relation to the stiffener for lifting the same up through the hollow tube in view of connecting it to the surface structure.

During this second phase, the stiffener is maintained to be translationally immobile within the hollow tube through embedding and/or fastening by means of hose clamps.

For these two steps to be performed successively, pulling systems are known using at least two different hoists. The cable of a first hoist is connected to the stiffener so as to be lifted up toward the lower end of the hollow tube, and the cable of a second hoist is connected to the upper end of the flexible line so as to move the same in relation to the stiffener. Such a system requires precise control of the lifting of the cables, and therefore is not easy to use, in particular if the hollow tube is bent.

In order to compensate for this problem, it is known from WO 98/23845 to use a single hoist for pulling the flexible line and the stiffener by temporarily integrating the stiffener with the flexible line by means of a frangible pin.

When the stiffener is lifted toward the lower end of the hollow tube, the stiffener and the flexible line will move together. Next, the stiffener is fastened to the lower end of the tube. Sufficient traction is then applied upward on the flexible line so as to break the frangible pin in order to allow for the flexible line to move upward in relation to the stiffener.

Such a device is not entirely satisfactory. In fact, such a device according to prior art is complex and requires mechanical parts to be highly reliable. Furthermore, once the frangible pin has broken, it is no longer possible to disconnect the line from the structure, then to reconnect it to the same structure or to another structure, without reinstalling a pin, which requires for the flexible line and the stiffener to be lifted up to the surface.

SUMMARY OF THE INVENTION

One objective of the invention is to obtain a device for mounting a flexible line on a structure, which is simple to use, and which reduces the risks of deteriorating the flexible line.

For this purpose, the object of the invention is a device of the above-mentioned type, characterized in that the axial immobilization means comprise:

- a locking member, axially integral with the first one of the flexible line and the curvature limiter, and
- a member for engaging the locking member, axially integral with the second one of the flexible line and the curvature limiter, the locking member and the engaging member being mounted to be rotatably movable in relation to each other around the travel axis between a configuration for axial immobilization in the first direction of the flexible line on the curvature limiter, and at least one first angularly shifted configuration for axial travel in the first direction of the flexible line through the curvature limiter.

The device according to the invention can have any or several of the following characteristics, taking individually or in any technically possible combination:

the locking member and the engaging member are movable in relation to each other along the travel axis between:

at least one disengaged axial position, in which the locking member and the engaging member are remote from each other and adopt a first configuration for axial travel in the first direction of the flexible line inside the curvature limiter;

an axial position for engaging the locking member inside the engaging member, in which the locking member and the engaging member are moved closer to each other;

an engaged axial position, in which the locking member and the engaging member adopt the configuration for axial immobilization in the first direction of the flexible line inside the curvature limiter;

the engaged axial position being located axially between the disengaged axial position and the engaging axial position;

the locking member and the engaging member have complementary surfaces suitable for cooperating so as relatively rotate the locking member in relation to the engaging member around the travel axis from the travel configuration to the configuration for axial immobilization, during the relative axial movement of the locking member in relation to the engaging member, successively between the disengaged axial position, the engaging position, and the engaged position;

the locking member comprises at least one transverse retaining projection, with the engaging member comprising at least one axial retaining stop of the or each projection, the axial retaining stop defining a main groove for engaging the projection axially opening in a second direction opposite the first direction, the or each projection being received inside the main groove in the configuration for axial immobilization;

the engaging member comprises a guiding stop axially shifted in relation to the or each axial retaining stop, with the guiding stop defining at least one secondary groove for guiding the retaining projection opening opposite the main groove in the first direction;

the complementary surfaces are respectively defined by the or each retaining projection on the one hand, and by the or each guiding stop and/or the or each axial retaining stop on the other hand;

one of the locking member and the engaging member is mounted to be freely rotatable around the travel axis, respectively on the first or the second one of the flexible line and the curvature limiter;

one of the locking member and the engaging member defines a receiving housing suitable for receiving the other one of the locking member and the engaging member in the configuration for axial immobilization; and the locking member and the engaging member are movable in relation to each other around the travel axis between the configuration for axial immobilization and at least one second configuration for axial travel, angularly shifted in relation to the first configuration for axial travel, with the configuration for axial immobilization being angularly located between the first and second configuration for axial travel.

Also an object of the invention is a fluid exploitation installation, of the type comprising:

a flexible line to be connected to the structure; and a device as defined above, the hollow rigid member being integral with the structure.

The invention may include the following characteristic: the structure, the hollow rigid member, and the flexible line are at least partially immersed into a body of water.

Also an object of the invention is a method for mounting a flexible line on a structure by means of a device as defined above, characterized in that it comprises the following steps:

axially immobilizing in the first direction the curvature limiter on the flexible line by engaging the locking member with the engaging member, so that the locking member and the engaging member adopt their configuration for axial immobilization in the first direction of the flexible line on the curvature limiter;

moving the curvature limiter and the flexible line together from the position away from the hollow rigid member to the position mounted on the hollow rigid member;

relatively rotating the locking member in relation to the engaging member around the travel axis, so as to transfer the locking member and the engaging member from the configuration for axial immobilization to a configuration for axial travel;

axial travelling of the flexible line through the curvature limiter and through the hollow rigid member, the curvature limiter remaining substantially axially immobile in relation to the hollow rigid member.

BRIEF DESCRIPTION OF THE DRAWINGS

The invention will be better understood by the following review, provided only by way of example, and given with reference being made to the enclosed drawings, where.

DESCRIPTION OF PREFERRED EMBODIMENTS

Figure 1:
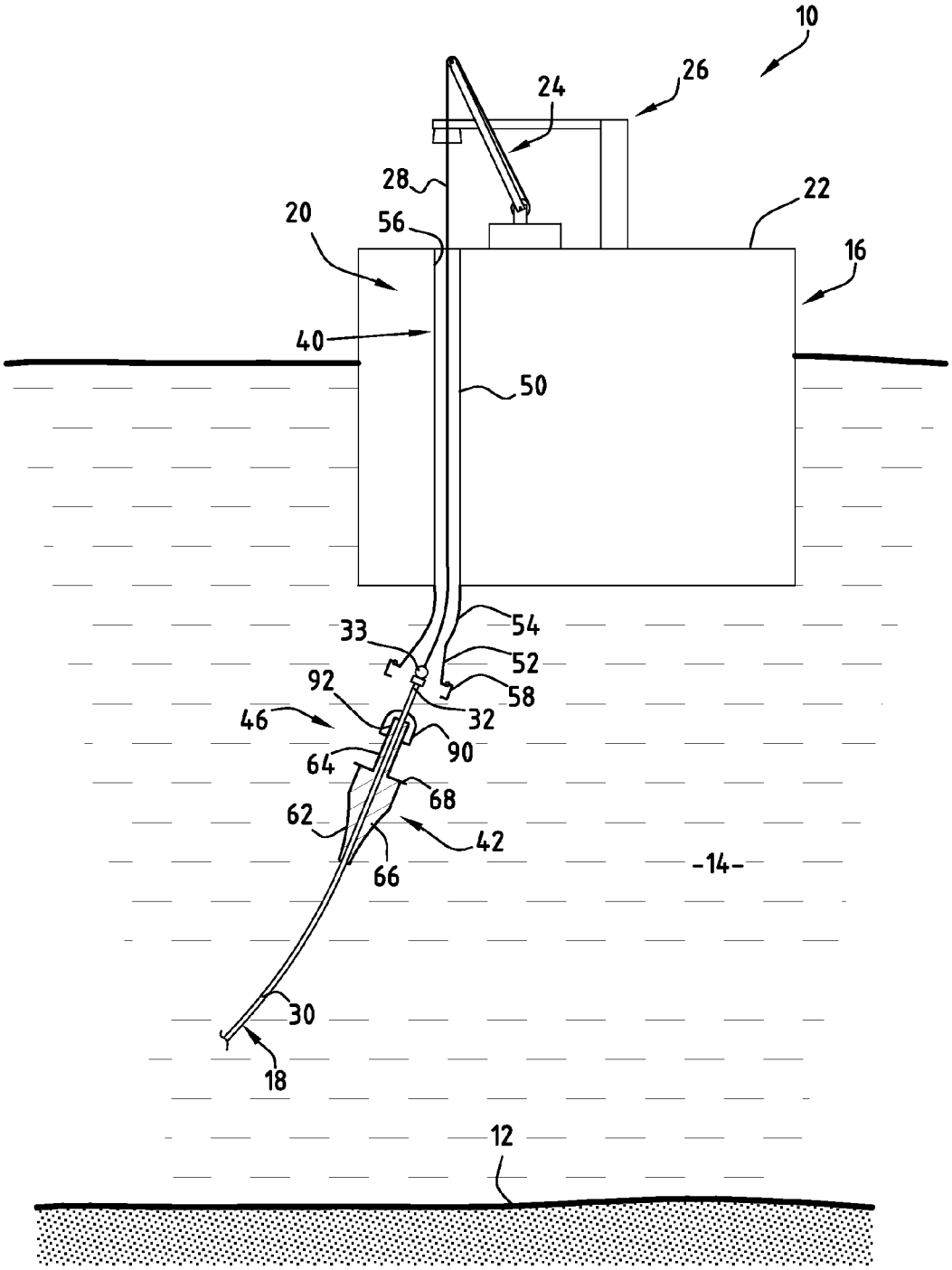
FIG. 1 is a schematic sectional view along a medial vertical plane, of a fluid exploitation installation, comprising a first mounting device according to the invention.

FIGS. 1 to 6 illustrate an installation 10 for exploitating fluids according to the invention. This installation is for instance intended to collect a fluid, namely a hydrocarbon tapped at the bottom 12 of a body of water 14, or transfer said hydrocarbon to a transport vessel.

The installation 10 comprises a structure 16 floating on the body of water 14, a flexible line 18 to be connected to the floating structure 16, and a first device 20 for mounting the flexible line 18 to the structure 16.

The body of water 14 is for instance a lake, a sea, or an ocean. The depth of the body of water perpendicular to the floating structure 16 is e.g. between 15 m and 3000 m.

The floating structure 16 is e.g. a surface naval base, a semisubmersible platform, a floating vertical column, or a vessel.

Alternatively, structure 16 is a jacket-like fixed rigid structure or an oscillating structure secured downward of the sea.

Floating structure 16 has an upper surface 22, on which is mounted a hoist 24 for handling the flexible line 18 and a manifold 26 adapted for connecting one end of the flexible line 18.

The hoist 24 comprises a single cable 28, which can be deployed for pulling the flexible line 18.

In the example represented in FIG. 1, the flexible line 18 is a fluid-carrying flexible tubular pipe 30 internally defining a fluid flow path. This pipe is also referred to as a rising pipe, or riser, and is to connect a wellhead located at the bottom 12 of the body of water to the manifold 26 located at the surface 22 of the floating structure 16.

Alternatively, flexible line 18 is e.g. an umbilical-like composite harness or "integrated service umbilical" (ISU) or IPB, well known by the person skilled in the art and described in the standards published by the American Petroleum Institute (API) API RP 17 B paragraph 4.3.4. Alternatively, the flexible line may be a harness of electrical cables.

Pipe 30 has at the upper end 32 thereof a head 33 for connecting the working line to the cable 28.

Figure 2:
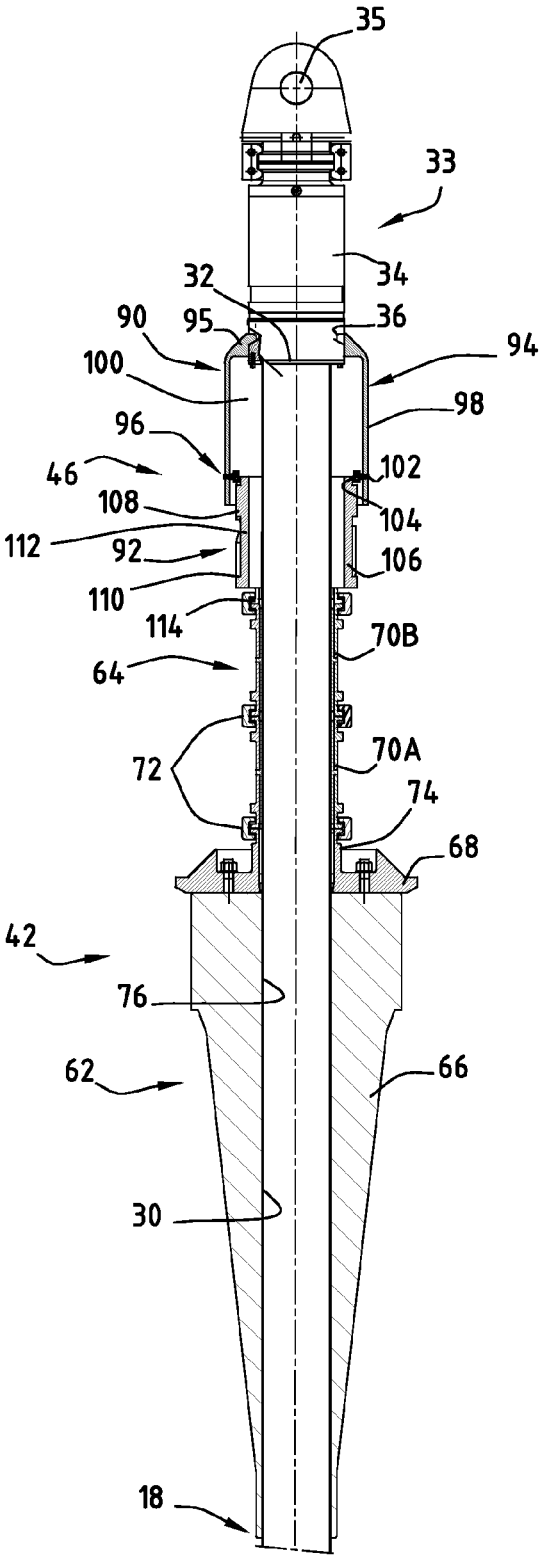
FIG. 2 is a partial sectional view, taken along a transverse plane, of the relevant parts of the means for axial immobilization of the flexible line inside the curvature limiter of the mounting device represented in FIG. 1, during engagement of the immobilization means.

As illustrated in FIG. 2, head 33 comprises a connecting sleeve 34 fastened to the upper end of the pipe 30, and an eyelet 35 for inserting the lower end of the working line to the cable 28, rotatably mounted on an upper part of the sleeve 34 around a travel axis X-X' of line 18.

Sleeve 34 defines in the lower part thereof an annular channel 36 circumferentially extending around axis X-X' and opening radially away from axis X-X'.

Pipe 30 is e.g. unwound and immersed into the body of water 14 from a surface laying vessel and is stored at the bottom 12 of the body of water 14, next the end of pipe 30 (section not laid on the seabed) is abandoned at the bottom 14 via a drop cable.

Mounting device 20 comprises a hollow rigid tube 40 for guiding and protecting the tubular line 18, which is integral with equipment 16, a local curvature limiter 42 of line 18, engaged around line 18 remote from the upper end 32, and means 44 for fastening the curvature limiter 42 to the lower end of the hollow rigid tube 40.

According to the invention, mounting device 20 further comprises releasable means 46 for axially immobilizing the flexible line 18 in the curvature limiter 42.

In the example represented in FIG. 1, the hollow rigid tube 40 is a J tube having a vertical straight upper part and a bent lower end. Alternatively, the hollow rigid tube 40 is a straight tube of the I tube type.

Tube 40 comprises a hollow vertical sleeve 50, integral with the floating structure 16, and a lower end collar 52 located at the lower end 54 of sleeve 50.

Sleeve 50 defines a lower passageway opening into the body of water 14 at lower end 54 and opening at the upper end 56 thereof close to the upper surface 22 of the structure, above the body of water 14.

The end collar 52 is immersed into the body of water 14. It has a truncated shape converging upward. It is attached to a fastening flange located at the lower end 54 of sleeve 50. Collar 52 flares out downward up to a lower flange 58 supporting fastening means 44, apparent in FIG. 5.

Figure 3:
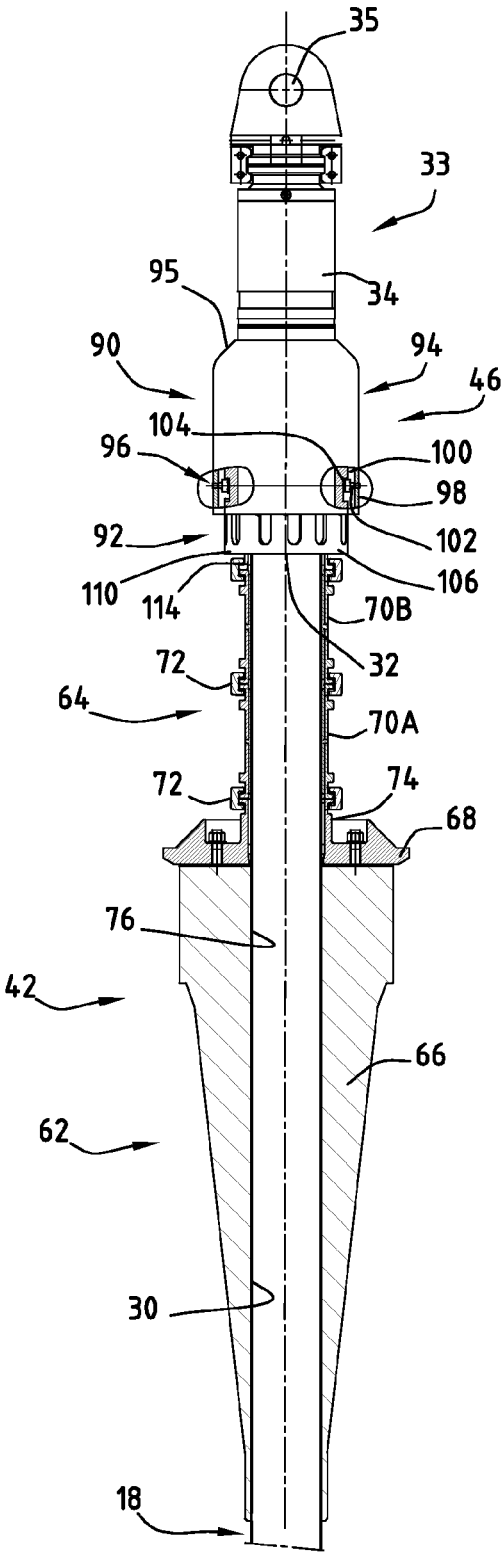
FIG. 3 is a view similar to FIG. 2, during axial immobilization of the flexible line inside the curvature limiter.

The curvature limiter 42 comprises, from bottom to top in FIGS. 2 and 3, a rigid lower assembly 62 and an articulated upper assembly 64 attached to the flexible lower assembly 62.

The flexible lower assembly 62 comprises a stiffening block 66 and an intermediate fastening flange 68 on the hollow rigid tube 40.

The lower block 66 is for instance molded from plastic material, such as polyurethane. It has a truncated shape converging downward.

Flange 68 is attached above block 66. It has a peripheral edge protruding radially remote from axis X-X' in relation to the stiffening block 66.

The articulated upper assembly 64 comprises a plurality of tubular vertebrae 70A, 70B axially assembled end to end via annular collars 72.

The lower vertebra 70A is fastened to an angle bracket 74 carried by the flange 68 via an annular collar 72.

Vertebrae 70A, 70B are slightly movable in relation to each other between a linear configuration along the axis X-X' and a configuration which is slightly curved in relation to the linear configuration.

Block 66, flange 68, and vertebrae 70A, 70B internally define a center lumen 76 for travel of the flexible line 18 specifying the travel axis X-X' of line 18 inside the curvature limiter 42, coinciding with the longitudinal axis of line 18.

In Block 66 and in vertebrae 70A, 70B, the lumen 76 has a cross-section which is substantially conjugate with the external cross-section of line 18.

Blocks 66 and vertebrae 70A, 70B thus locally enforce upon the flexible line 18 a radius of curvature which is greater than the minimum radius of curvature which could be adopted by the flexible line 18.

As will be apparent below, the curvature limiter 42 is movable between a dismantled position represented in FIG. 1, in which it is placed remote from the hollow rigid tube 40, and a position mounted on the hollow rigid tube 40, represented in FIGS. 5 et 6, in which the intermediate flange 68 of the limiter 42 is fastened to the lower supporting flange 58, at the lower end of collar 52.

The fastening means 44 comprise an annular collar 78 for retaining the intermediate flange 68 against the lower flange 58.

According to the invention, the axial immobilization means 46 in a first direction of the curvature limiter 42 on flexible line 18 are formed by a reversible rotatable latch, a so-called "rotolatch".

Such axial immobilization means 46 thereby comprise a rotatable latching member 90, mounted to be axially integral with line 18, and an engaging member 92 of the locking member 90, mounted to be axially integral with curvature limiter 42.

The locking member 90 comprises a rotatable bell 94 and a plurality of transverse projections 96 radially extending toward axis X-X' inside the rotatable bell 94.

The bell 94 has an upper annular wall 96 mounted to be freely rotatable in relation to line 18 around axis X-X' in groove 36, and a substantially cylindrical side wall 98 opening downward.

The locking member 90 is thus mounted to be axially fixed in relation to line 18, while being mounted to be freely rotatable around axis X-X'.

The upper annular wall 96 and the side wall 98 internally define a housing 100 for receiving the engaging member 92. Housing 100 extends along axis X-X' and opens downward.

In the example represented, the locking member 90 comprises a plurality of retaining projections 96, angularly distributed around axis X-X'.

Each projection 96 radially extends toward axis X-X' within the receiving housing 100, from the side wall 98 to the proximity of the lower rim of bell 94.

Each projection 96 comprises a stud 102 fastened in the side wall 98 and a runner 104 rotatably mounted around a radial axis at the free end of the stud 102. Each runner 104 defines an external running surface 105 on the engaging member 92.

The engaging member 92 comprises a ring 106 mounted to be axially fixed and mounted to be freely rotatable around axis X-X' at the upper end of vertebrae 70. The ring 106 defines a plurality of upper axial retaining stops 108 of the projections 96, and a lower annular stop 110 for guiding the projections 96.

The ring 106 comprises a substantially cylindrical sleeve 112 having an axis X-X' and a lower fastening collar 114 on the upper vertebra 70B extending sleeve 112 downward.

The collar 114 is fastened to the upper vertebra 70B via an annular clamping collar 116.

The upper retaining stops 108 radially project away from axis X-X' toward the rotatable bell 94, from an external surface of sleeve 112. They are angularly distributed around axis X-X' on a circumference of sleeve 112, while being angularly spaced from each other.

Figures 4A, 4B, 4C, 4D, 4E, 4F, 4G, 4H, 4I:
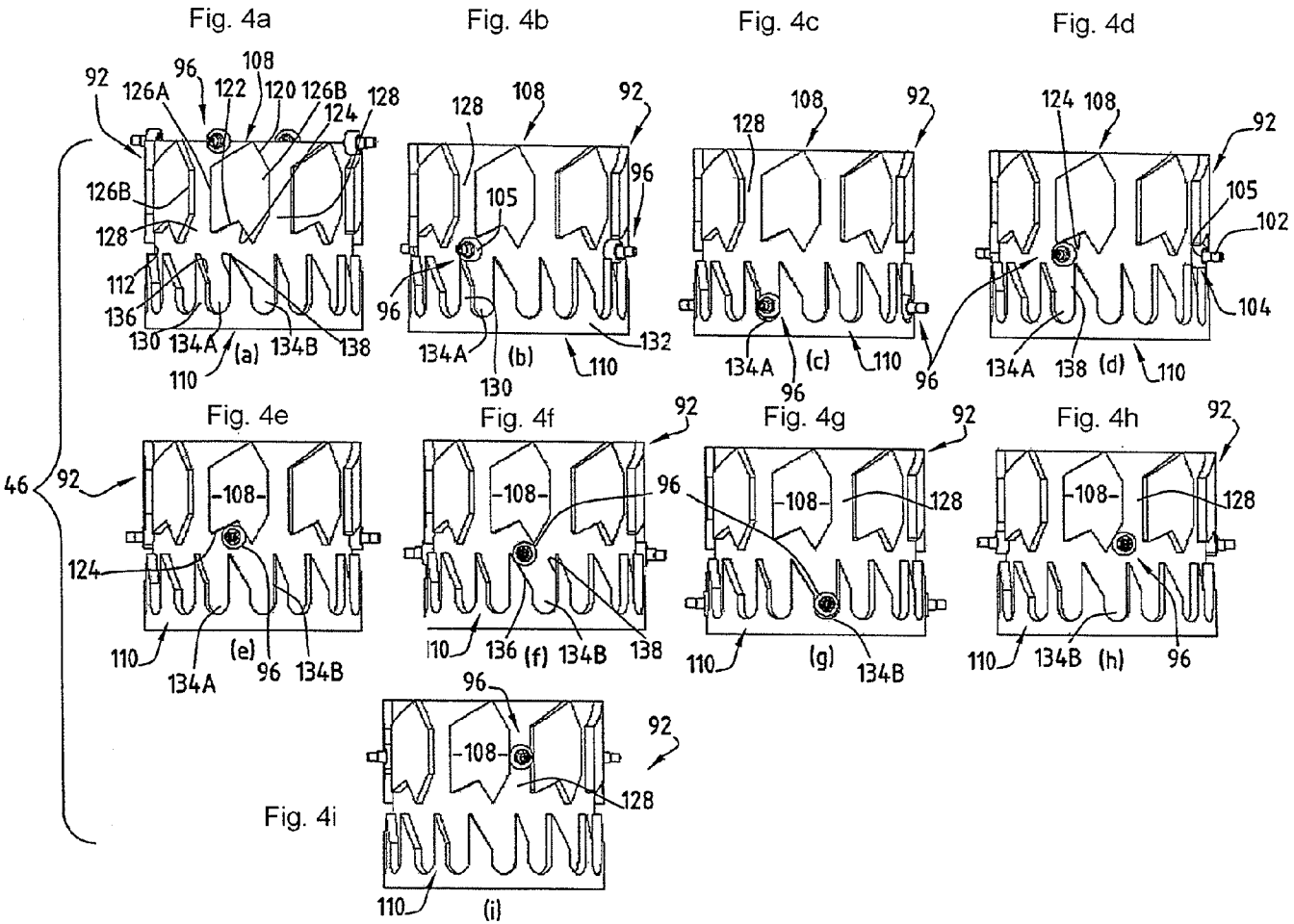
FIG. 4(*a*),-4(*i*) are a partial views from a side perspective of the immobilizing projections and the corresponding stops of the immobilization means represented in FIGS. 2 and 3, during the successive steps of engaging, locking, and unlocking of the flexible line inside the curvature limiter.

As illustrated in FIG. 4, each upper stop 108 has a polygonal outline. Each stop 108 thereby defines an upper rim 120 convex upward and having a pointed shape, a lower rim 122 concave upward and defining a main groove 124 for engaging a projection 96, and two side rims 126A, 126B extending substantially in parallel to axis X-X'.

The side rims 126A, 126B opposite each pair of adjacent upper stops 108 define therebetween axial passageways 128 for inserting and removing a projection 96 into/from the groove 124.

Each passageway 128 axially opens upward in a first direction, between the upper rims 120 of two adjacent upper stops 108 and axially downward in a second direction opposite the first direction, close to the groove 124.

Groove 124 is axially sealed upward in the first direction and axially opens downward in a second direction. It has a cross-sectional shape like an inverted V.

The lower retaining stop 110 radially projects away from axis X-X' from the external surface of sleeve 112. It extends under the retaining stops 108. It defines a plurality of teeth 130 projecting upward in the first direction from a solid annular base 132.

The teeth 130 together define, opposite each main groove 124, two secondary guiding grooves 134A, 134B.

Grooves 134A, 134B are sealed in the second direction downward and open in the first direction upward opposite the main groove 124.

Each groove 134A, 134B is defined to the left by the inclined lateral surface 136 of a first tooth 130, and is defined to the right by a straight surface 138 of a tooth 130 adjacent to the first tooth 130.

The left-hand groove 134A partially opens along the inclined surface 136 opposite an insertion and removal way 128 located to the left of stop 108. The right-hand groove 134B partially opens opposite an insertion and removal way 128 located to the right of stop 108.

Each upper stop 108 and the lower stop 122 thereby together define a traveling way of a projection 96, which is substantially W-shaped.

As will be apparent below, the locking member 90 is movable along the travel axis X-X' in relation to the engaging member 92 in the second direction, between a first disengaged axial position, represented in FIG. 4(*a*), in which the locking member 90 and the engaging member 92 are axially remote from each other, and an axial position engaging the locking member 90 with the engaging member 92, represented in FIG. 4(*c*), in which the locking member 90 is moved closer to the engaging member 92, and the projections 96 come into abutment at the bottom of the secondary guiding grooves 134A.

Starting from the engaging position of FIG. 4(*c*), the locking member 90 is further movable in the first direction upward along axis X-X' toward an engaged axial position, represented in FIG. 4(*e*), located axially between the first disengaged axial position, in which each projection 96 is placed at the bottom of a main groove 124.

During such movements, the locking member 90 is further rotatably movable around the axis X-X' in relation to the engaging member 92 and in relation to the line 18 between a first travel configuration of the flexible line 18 through the curvature limiter 42 (FIG. 4(*a*)) and an configuration for axial immobilization in the first direction of the flexible line 18 on the curvature limiter 42 (FIG. 4(*e*)).

Advantageously, the immobilization means 46 can comprise a releasable member (not shown) for blocking the locking member 90 in relation to the engaging member 92 translatably in the engaged axial position and rotatably in the configuration for axial immobilization. This blocking member is for instance a screw or a pin, which can be fitted and released without mechanical breakage of the blocking member by a remotely operated vehicle (referred to by the abbreviation ROV).

Starting from the engaged axial position, the locking member 90 is movable downward along axis X-X' in relation to the engaging member 92, between the engaged position and a disengaging position, represented in FIG. 4(*g*), in which the projections 96 are located in abutment in secondary grooves 134B adjacent to grooves 134A, then upward up to a second disengaged axial position represented in FIG. 4(*i*).

During such movements, the locking member 90 is rotatably movable around the engaging member 92 between the configuration for axial immobilization in a first direction and a second configuration for axial travel of the flexible line 18 through the curvature limiter 42, angularly shifted in relation to the first configuration for axial travel, without mechanical breakage of a linking member between the engaging member 92 and the locking member 90.

A method for mounting the flexible line 18 to the floating structure 16 will now be described with reference to FIGS. 1 to 6.

Initially, when the flexible line 18 is stored in a vessel or ashore, a curvature limiter 42 is engaged around the line 18, remote from the upper end 32.

For this purpose, the line 18 is inserted into the lumen 76 successively through lower block 66, intermediate flange 68 and vertebrae 70A, 70B. Next, the connecting head 33, on which the locking member 90 is mounted rotatably, is axially and angularly fastened to line 18, at the upper end 32 of pipe 30.

The curvature limiter 42 is maintained to be axially fixed, line 18 is moved in the second direction downward in relation to the limiter 42 so as to move the locking member 90 closer to the engaging member 92 and bring them into the first disengaged axial position, represented in FIGS. 2 and 4(*a*).

When the engaging member 92 enters into the receiving housing 100, each runner 104 comes into abutment at the upper rim 120 of a stop 108 and is guided toward an inserting passageway 128.

The locking member 90 and the engaging member 92 then adopt the first configuration for axial travel in the first direction of the flexible line 18 through the curvature limiter 42.

Next, the axial movement downward in the second direction of the line 18 in relation to the limiter 42 continues. The runner 104 of each projection 96 moves down the passageway 128, next into the secondary groove 134A located opposite this passageway, running downward along an inclined surface 136.

As represented in FIG. 4(*b*), the cooperation between the external surface 105 of the runner 104 and the inclined side surface 136 of the tooth 130 causes partial rotation of the locking member 90 in relation to the engaging member 92 through a cam effect from the first travel configuration to the configuration for axial immobilization.

With reference to FIG. 4(*c*), when the projection 96 comes into abutment at the bottom of the left-hand groove 134A, line 18 is then moved axially upward in the first direction in relation to the limiter 42. Projection 96 then moves upward along the right-hand surface 138 of the secondary groove 134A and enters into the main groove 124 (FIG. 4(*d*)).

The runner 104 then runs on the convex lower rim 122 of the upper stop 108. Running of the runner 104 causes the locking member 90 to be rotatably driven around axis X-X' in relation to the engaging member 92 up to the configuration for axial immobilization represented in FIG. 4(*e*).

In this configuration, each projection 96 is placed inside a main groove 124 in abutment against an upper retaining stop 108. This will axially immobilize the flexible line 18 in the first direction inside the curvature limiter 42, namely when a upward pulling force is applied to line 18. Thereby, axial immobilization means 46 are activated.

Line 18 is then immersed into the body of water 14. When line 18 is to be connected to the manifold 26 of the structure 16, the hoist 24 is activated for lowering the cable 28 through the hollow rigid tube 40, next connecting the lower end of the cable 28 to the connecting head 33 located at the upper end 32 of line 18. Line 18 and the curvature limiter 42 are placed under the end collar 52 of the hollow rigid tube 40 away from tube 40.

The hoist 24 is then activated for lifting the cable 28 up to the upper end 56 of the hollow rigid tube 40. Lifting the cable 28 causes the line 18 to be moved together with the curvature limiter 42 toward the collar 52 up to the intermediate position represented in FIG. 1.

Next, the curvature limiter 42 is partially introduced into the rigid tube 40.

For this purpose, the flexible upper assembly 64 is introduced into the end collar 52, until the intermediate flange 68 rests on the lower flange 58 of the collar.

Figure 5:
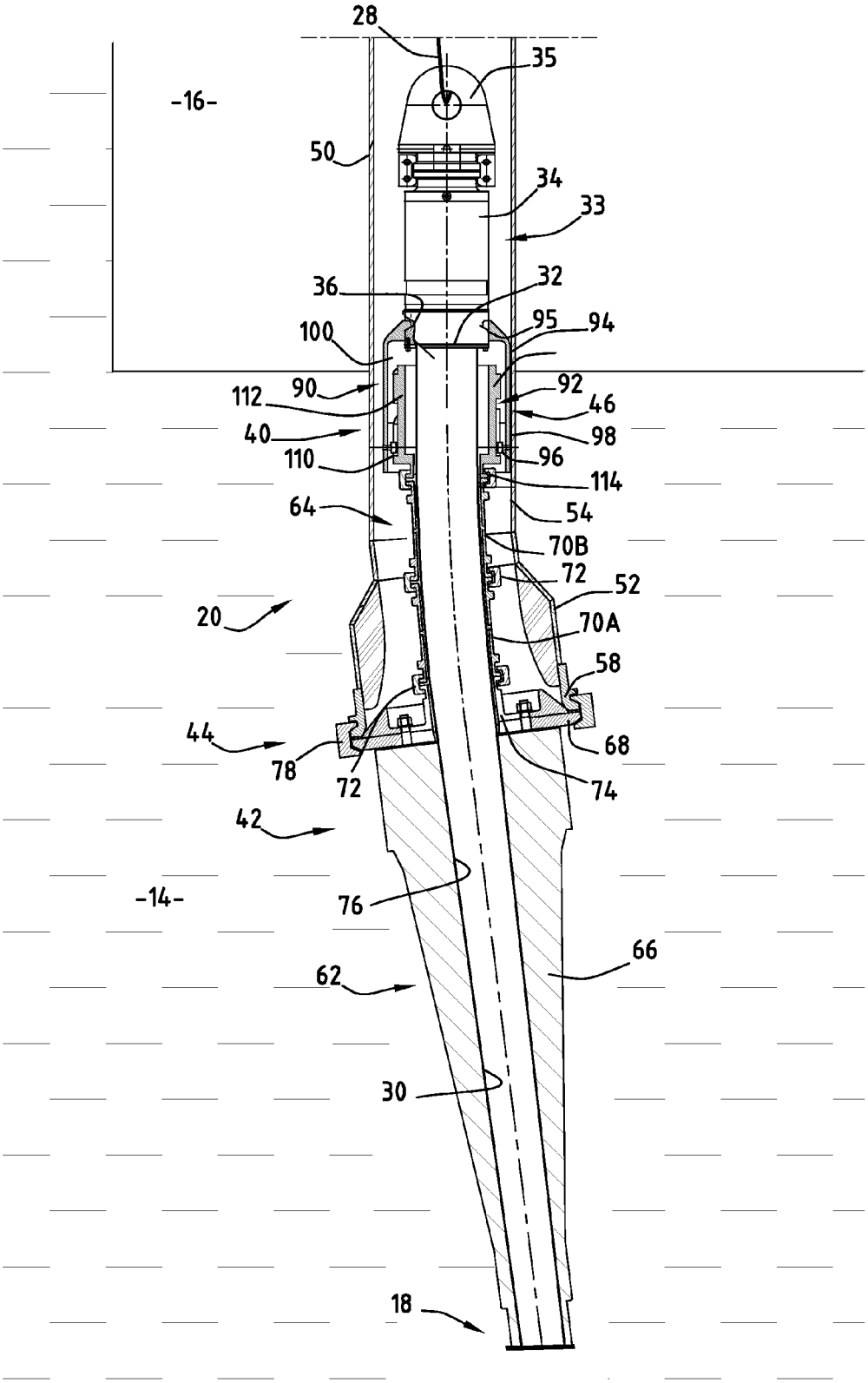
FIG. 5 is a detail view of the lower end of a rigid protecting tube of the mounting device according to the invention, when the curvature limiter is fastened to this tube.

With reference to FIG. 5, the collar 78 is then placed around the flanges 58, 68 for immobilizing the curvature limiter 42 axially in relation to the hollow tube 40.

As vertebrae 70A, 70B are linked together by flexible links, they adopt a slight curvature corresponding to the slightly curved shape of the lower end of tube 40.

Immobilization means 46 are then released to allow for line 18 to be lifted up through curvature limiter 42 and tube 40.

For this purpose, the hoist 24 is activated to move the connecting head 33 in the second downward direction.

As illustrated in FIGS. 4(*f*) to 4(*g*), each projection 96 then moves down into the straight groove 134B adjacent to the left-hand groove 134A, guided by the runner 104 on the inclined surface 136 defining groove 134B.

Cooperation between the external surface 105 of the runner 104 and the inclined surface 136 inside the groove 134B will rotatably drive the locking member 90 around axis X-X' from the configuration for axial immobilization thereof to a second travel configuration of line 18, represented in FIG. 4(*i*), axially spaced apart from the first travel configuration represented in FIG. 4(*a*).

The locking member 90 turns around axis X-X' always in the same direction between the first travel configuration, the configuration for axial immobilization, and the second travel configuration.

With reference to FIG. 4(*g*), when each projection 96 comes into abutment at the bottom of the secondary groove 134B, the hoist 24 is then activated to move head 33 upward in the first direction.

The locking member 90 then moves away from the engaging member 92, causing each projection 96 to be moved outside straight groove 134B, next along the straight rim 126B of the upper stop 108 inside the removal passageway 128 (FIGS. 4(*h*) and 4(*i*)).

The locking member 90 then adopts a disengaged axial position located above the engaging member 92, in which the engaging member 92 has been removed from the housing 100.

Figure 6:
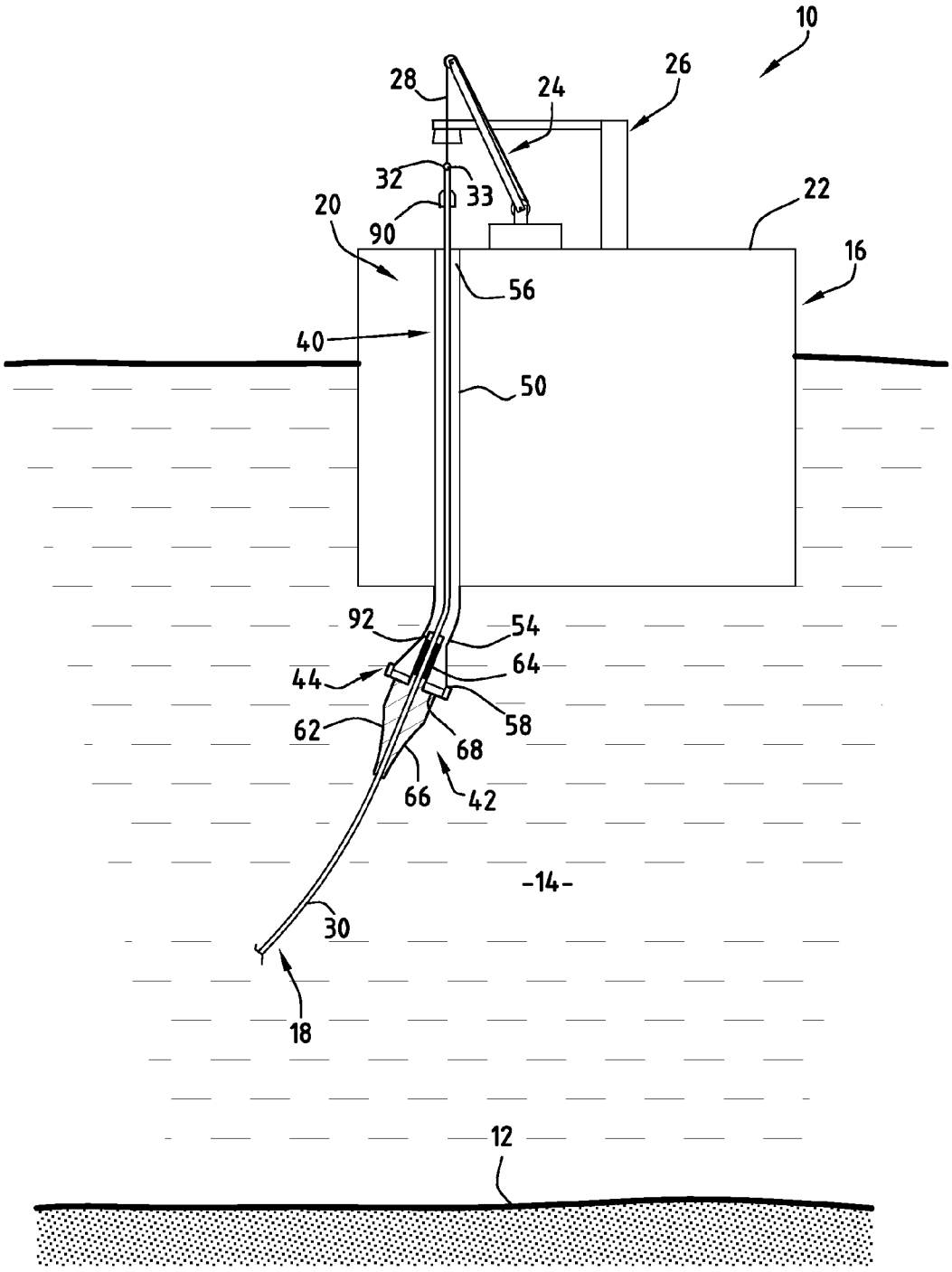
FIG. 6 is a view similar to FIG. 1, during axial travel of the flexible line inside the curvature limiter.

With reference to FIG. 6, line 18 is then lifted up through the center lumen 76 of the limiter 42 and through the traveling way of the tube 40, up to the manifold 26, the curvature limiter 42 remaining immobile in relation to tube 40. Line 18 is then connected to the manifold 26.

The releasable immobilization means 46 formed by a rotatable lock are thus easily activated, so as to allow, by means of a single hoist, a common movement of the curvature limiter 42 and line 18 up to the hollow rigid tube 40. Next, once the limiter 42 has been fastened to the hollow rigid tube 40, the immobilization means are reversibly released, simply by moving line 18, so as to allow for line 18 to move up through the curvature limiter 42 and through tube 40.

It is not necessary to apply considerable pulling force to the immobilization means 46, or break a linking member between the locking member 90 and the engaging member 92 for axially releasing line 18 in relation to curvature limiter 42. The risk of deteriorating line 18 is thus very limited.

When line 18 is to be removed from the structure 16, it is moved down into the hollow tube 40, until the locking member 90 engages around the engaging member 92 in the configuration for axial immobilization thereof, as described before.

The collar 78 of the fastening means 44 is then removed, so as to remove the curvature 42 from the collar 52 and move line 18 together with curvature limiter 42 down, away from the hollow tube 40.

What is claimed is:

1. A device for mounting a flexible line on a structure, comprising:

a hollow rigid member, configured to be integral with the structure, the hollow rigid member defining a traveling way of the flexible line;

a curvature limiter defining an insertion lumen for receiving the flexible line, the insertion lumen having a travel axis of the flexible line, the curvature limiter being movable relative to the hollow rigid member between a position away from the hollow rigid member and a position mounted on the hollow rigid member;

a releasable axial immobilization device, the axial immobilization device configured to immobilize axially the curvature limiter on the flexible line in at least one first direction along the travel axis, and configured to move the flexible line together with the curvature limiter relative to the hollow rigid member between the position away from the hollow rigid member and the mounted position;

the axial immobilization device comprises:

a locking member axially integral with one of the flexible line and the curvature limiter; and an engaging member configured to engage the locking member and axially integral with the other one of the flexible line and the curvature limiter, wherein the locking member and the engaging member are mounted to be rotatably movable in relation to each other around the travel axis between:

a configuration for axial immobilization in the first direction of the flexible line on the curvature limiter, and at least one first angularly shifted configuration for axial travel in the first direction of the flexible line through the curvature limiter.

2. The device according to claim 1, wherein the locking member and the engaging member are movable in relation to each other along the travel axis between:

at least one disengaged axial position, in which the locking member and the engaging member are remote from each other and adopt a first configuration for axial travel in the first direction of the flexible line inside the curvature limiter;

an axial position for engaging the locking member with the engaging member, in which the locking member and the engaging member are moved closer to each other;

an engaged axial position, in which the locking member and the engaging member adopt the configuration for axial immobilization in the first direction of the flexible line inside the curvature limiter; and the engaged axial position being located axially between the disengaged axial position and the engaging axial position.

3. The device according to claim 2, wherein the locking member and the engaging member comprise complementary surfaces configured to cooperate to relatively rotate the locking member in relation to the engaging member around the travel axis from the travel configuration to the configuration for axial immobilization, during the relative axial movement of the locking member in relation to the engaging member, successively between the disengaged axial position, the engaging position, and the engaged position.

4. The device according to claim 1, wherein the locking member comprises at least one transverse retaining projection, and the engaging member comprises at least one axial retaining stop for each transverse retaining projection, wherein the axial retaining stop defines a main groove positioned and configured to engage the projection axially opening in a second direction opposite the first direction, and each transverse retaining projection is received inside the main groove in the configuration for axial immobilization.

5. The device according to claim 4, wherein the engaging member comprises a guiding stop axially shifted in relation to each axial retaining stop, the guiding stop defining at least one secondary groove positioned and configured to guide the retaining projection opening opposite the main groove in the first direction.

6. The device according to claim 5, wherein the locking member and the engaging member comprise complementary surfaces configured to cooperate to relatively rotate the locking member in relation to the engaging member around the travel axis from the travel configuration to the configuration for axial immobilization, during the relative axial movement of the locking member in relation to the engaging member, successively between the disengaged axial position, the engaging position, and the engaged position;

the complementary surfaces are respectively delimited by each retaining projection on the one hand, and by each guiding stop and/or each axial retaining stop on the other hand.

7. The device according to claim 1, wherein one of the locking member and the engaging member is mounted to be freely rotatable around the travel axis, respectively on the first or the second one of the flexible line and the curvature limiter.

8. The device according to claim 1, wherein one of the locking member and the engaging member defines a receiving housing for receiving the other one of the locking member and the engaging member in the configuration for axial immobilization.

9. The device according to claim 1, wherein the locking member and the engaging member are movable in relation to each other around the travel axis between the configuration for axial immobilization and at least a second configuration for axial travel, angularly shifted in relation to the first configuration for axial travel, with the configuration for axial immobilization being angularly located between the first and second configuration for axial travel.

10. The device according to claim 1, wherein the locking member defines a central passage configured to receive the flexible line, the central passage being open downwardly and upwardly such as that the flexible line extends through the locking member via the central passage.

11. The device according to claim 1, wherein the engaging member device defines a central passage configured to receive the flexible line, the central passage being open downwardly and upwardly such as that the flexible line extends through engaging member via the central passage.

12. The device according to claim 1, wherein the locking member defines a central passage configured to receive the flexible line, the central passage being open downwardly and upwardly such as that the flexible line extends through the locking member via the central passage, and the engaging member device defines a central passage configured to receive the flexible line, the central passage being open downwardly and upwardly such as that the flexible line extends through the engaging member via the central passage.

13. A fluid exploitation installation, comprising:

a structure;

a flexible line configured to be connected to the structure; and the device according to claim 1, wherein the hollow rigid member is integral with the structure.

14. The installation according to claim 13, wherein the structure, the hollow rigid member, and the flexible line are configured to be at least partially immersed into a body of water.

15. A method for mounting a flexible line on a structure by means of the device according to claim 1, the method comprising:

axially immobilizing in the first direction the curvature limiter on the flexible line by engaging the locking member with the engaging member, so that the locking member and the engaging member adopt the configuration for axial immobilization;

moving the curvature limiter and the flexible line together from the position away from the hollow rigid member to the position mounted on the hollow rigid member;

relatively rotating the locking member in relation to the engaging member around the travel axis, so as to transfer the locking member and the engaging member from the configuration for axial immobilization to a configuration for axial travel;

axial travelling of the flexible line through the curvature limiter and through the hollow rigid member, the curvature limiter remaining substantially axially immobile in relation to the hollow rigid member.

* * * * *

UNITED STATES PATENT AND TRADEMARK OFFICE

CERTIFICATE OF CORRECTION

PATENT NO. : 8,596,912 B2
APPLICATION NO. : 12/995213
DATED : December 3, 2013
INVENTOR(S) : Routeau et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 368 days.

Signed and Sealed this
Twenty-second Day of September, 2015

Michelle K. Lee

Michelle K. Lee
*Director of the United States Patent and Trademark Office*